United States Patent [19]

Swanson

[11] Patent Number: 4,785,561

[45] Date of Patent: Nov. 22, 1988

[54] SNOW REMOVAL METHOD

[76] Inventor: Eleanor V. Swanson, 2135 Indiana Ave., Golden Valley, Minn. 55422

[21] Appl. No.: 50,876

[22] Filed: May 18, 1987

[51] Int. Cl.[4] ..... E01H 5/10

[52] U.S. Cl. ..... 37/197; 37/228; 126/343.5 R

[58] Field of Search ..... 37/228, 227, 229, 197; 126/343.5 R; 56/327 R, 16.5

[56] References Cited

U.S. PATENT DOCUMENTS

| | | | |
|---|---|---|---|
| 1,004,113 | 9/1911 | Van Wye | 37/228 |
| 3,452,459 | 7/1969 | Campion | 37/229 |
| 3,619,918 | 11/1971 | Morin | 37/228 |
| 3,866,340 | 2/1975 | Krickovich | 37/228 |
| 4,615,129 | 10/1986 | Jackson | 37/228 X |

FOREIGN PATENT DOCUMENTS

| | | | |
|---|---|---|---|
| 27519 | 2/1907 | Austria | 37/228 |
| 2221586 | 10/1974 | France | 37/228 |

*Primary Examiner*—Edgar S. Burr
*Assistant Examiner*—Moshe I. Cohen
*Attorney, Agent, or Firm*—Kinney & Lange

[57] ABSTRACT

Snow removal equipment includes a snowblower on a truck delivering snow into the top of a snow reduction chamber on the back of the truck. The snow falls on several spaced apart, horizontal layers of hot, mutually parallel closely spaced tubes. The snow melts when it hits the tubes and the resulting liquid water is stored in the chamber until it is discharged from the chamber into a storm sewer.

4 Claims, 4 Drawing Sheets

SNOW REMOVAL METHOD

BACKGROUND OF THE INVENTION

1. Field of the Invention.

This invention has relation to snow removal apparatus wherein snow is removed from the ground, delivered into a snow reduction chamber where it is reduced to liquid water, and the liquid water is discharged into an appropriate sewer-like receptacle.

2. Description of the Prior Art.

It has been recognized for many years that a logical way to remove snow from streets and highways is by converting it into liquid water; and for that reason, many devices have been evolved to melt snow for disposal. See, for example, the following U.S. patents.

U.S. Pat. No. 3,304,632 to Kotlar et al. in Feb. 1967;
U.S. Pat. No. 3,309,798 to Devlin et al. in Mar. 1967;
U.S. Pat. No. 3,452,459 to Campion in July 1969;
U.S. Pat. No. 3,464,128 to Krickovich in Sept. 1979; and
U.S. Pat. No. 4,353,176 to Hess in Oct. 1982.

The patent to Campion discloses the use of a high volume of air flow to draw air from the ambient temperature to entrain water vapor and moisture from melted and melting snow and to carry this air-entrained water vapor back into the outside atmosphere. FIG. 1 discloses the discharge of snow from a snowblower into a snow reduction chamber equipped with a plurality of spaced-apart Calrod units throughout the chamber. It also discloses, in FIG. 5, the discharge of snow through the top of a snow reduction chamber into open ended and perforated tubes which are discharging the products of combustion into the chamber, with the discharge of water vapor coming out of the top of the snow reduction chamber. Campion appears to depend on the low humidity of cold ambient outside air to pick up the moisture laden air inside of his snow reduction chamber and to depend on an enormous air flow with the resulting dissipation of an enormous amount of heat energy to accomplish this transfer. It is suggested that the moisture laden air discharged from his apparatus will substantially instantaneously lose its moisture in the form of new falling snow.

The patent to Kotlar et al. discloses the use of high pressure/velocity air supplied to an oil burner to provide a flow of combustion products and air into which is entrained snow to be reduced, the snow presumably being carried to the end of a snow melting chamber 40 where the liquid water drops through into an otherwise unheated water tank 60 while the combustion products and any remaining air passes out through exhaust stack 49. This system appears to involve the discharge of immense amounts of heat energy into the ambient atmosphere; and would appear to be quite susceptible to clogging or choking when subjected to the introduction of very large amounts of snow or snow which is full of ice. See the patent to Devlin, column 1, sentence beginning on line 24.

The patent to Devlin et al. deposits the snow inside of its snow reduction chamber onto an auger and moves it through a perforated tube as a slurry. While moving through the tube, water in a tank at the bottom of the snow reduction chamber is heated in a boiler and is introduced into the snow moving through the perforated cylinder to be discharged at the open end thereof into the tank. A substantial quantity of heat energy must be injected into the water initially in the tank before the Devlin apparatus is ready to receive snow. Also, although provision is made so that any large rocks discharge from the open end of the auger cylinder are separated from the other liquid water, the gravel, dirt, roadside and street trash and the like which are inevitably picked up in any snow removal process are all comingled with the heated circulated water and will, it is respectfully contended, inevitably serve to clog up the boiler tubes when they are part of the water being circulated.

The patent to Hess relies on a combustion burner which produces combustion gases which are forced up through pipes encircling the outside of a rounded V-shape container and down into the snow which is collected in this container. An auger in the bottom of the container agitates the slurry of solid water (snow and ice) and liquid water and tends to carry it toward the rear lower portion of the rounded V-shape container where the water flows up around the V-shape container until it is drained away through an exit port. It appears as though all of the heat energy put into the snow reduction process, and any that is not utilized in the process, is discharged along with the liquid water, and not recirculated.

The patent to Krickovich discloses what is the equivalent of a large stew pot into which snow is loaded, the pot being stirred by spokes of agitators 56 and 64, and the pot being heated using a series of gas burners 68 not unlike gas burners used to heat a stew pot in a kitchen. Evidently the snow first discharged into this pot, if the pot is preheated, will tend to flash over into vapor and/or immediately melt. When sufficient snow has built up so that the paddles of the agitator 56 are moving the snow, the snow and liquid water are present in the form of a slurry.

What was needed before the present invention was a snow removal apparatus having a snow reduction chamber so designed that individual molecules of frozen water (snow and ice) can be brought in contact with a surface having a temperature above the melting point so that the conversion of the individual molecules from frozen to liquid state can be accomplished substantially instantaneously to prevent snow buildup in the chamber and resultant clogging or choking of the chamber.

Also needed was a means for having sufficient heat energy in all surfaces actually contacted by the snow and ice so that instantaneous melting will occur in those molecules actually touching the surface and by adjacent molecules by conduction; with the excess of heat energy being retained and not discharged with the liquid water or into the atmosphere.

SUMMARY OF THE INVENTION

Before the present invention, a snow removal apparatus could include a motorized vehicle, a powered snowblower mounted on the front of the vehicle and having an outlet chute, a snow reduction chamber mounted on the vehicle, and a snow delivery conduit open from the outlet chute of the snowblower to an upper portion of the snow reduction chamber.

In the improved apparatus presented herein, a lower portion of the snow reduction chamber is constituted as a tank with a liquid water outlet port at the bottom of the tank. The chamber also has a snow and ice entry port at its central upper portion. At least one field of relatively closely spaced, heated boiler tubes is situated in the chamber and lies generally in a single plane in position to intercept snow and ice entering the chamber entry port where these heated tubes will reduce the snow and ice to liquid water.

In the form of the invention as shown, the heated boiler tubes are constituted as parts of a closed heat transfer system including a continuous boiler pipe, a heat exchange fluid within the boiler pipe, means outside of the snow reduction chamber for heating the boiler pipe, and means for circulating the heat exchange fluid within the pipe.

In the form of the invention as shown, the first field of heated tubes lies in a generally horizontal plane and a second field of heated tubes lies in generally parallel relation to the first field of tubes, is spaced from it, and is in position to intercept and melt snow and ice passing between the tubes of the first field and coming into contact with the tubes of the second field.

Means is also provided within the snow reduction chamber for heating the interior of the chamber and the atmosphere within the chamber at least as a warm-up before introducing snow into the chamber.

DETAILED DESCRIPTION OF THE PREFERRED EMBODIMENTS

Figure 1:
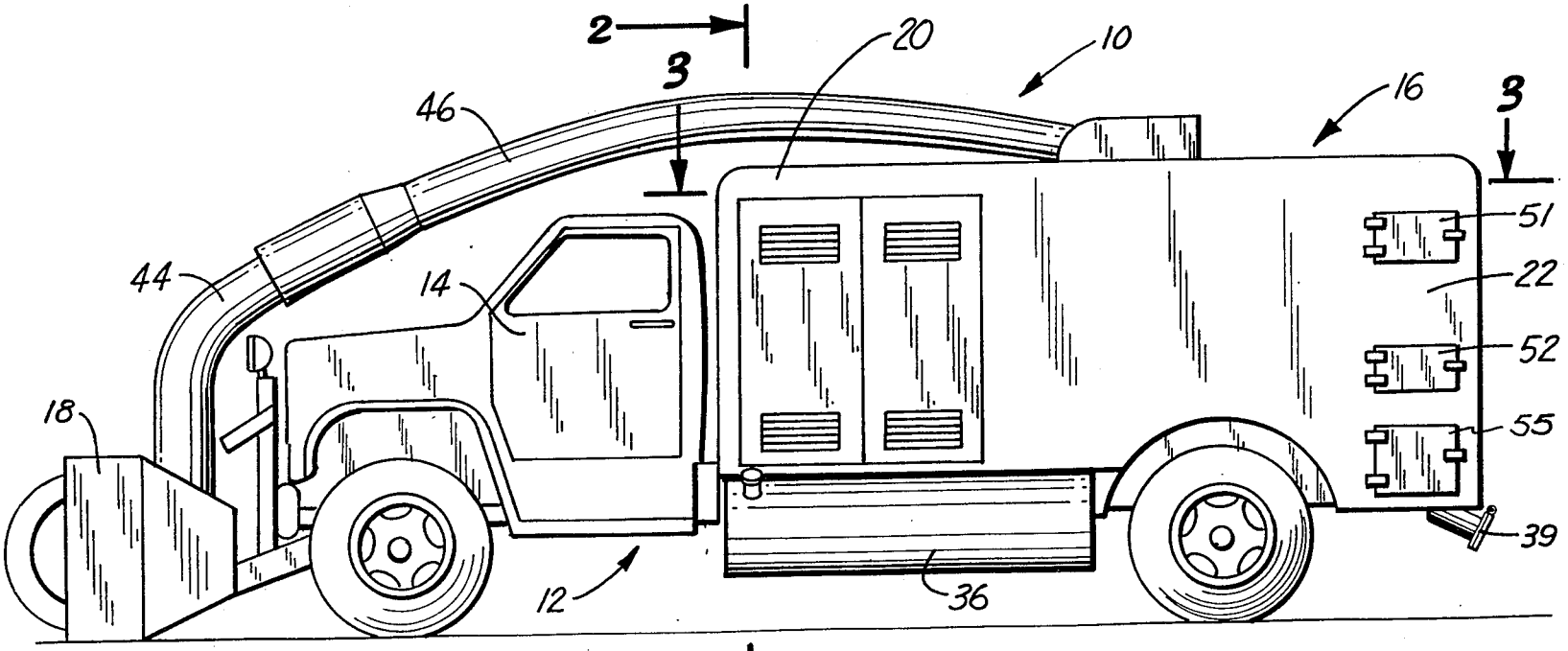
FIG. 1 is a side elevational view of a motorized vehicle carrying a powered snowblower and supporting a truck box including a snow reduction chamber embodying features of the present invention.
Figure 2:
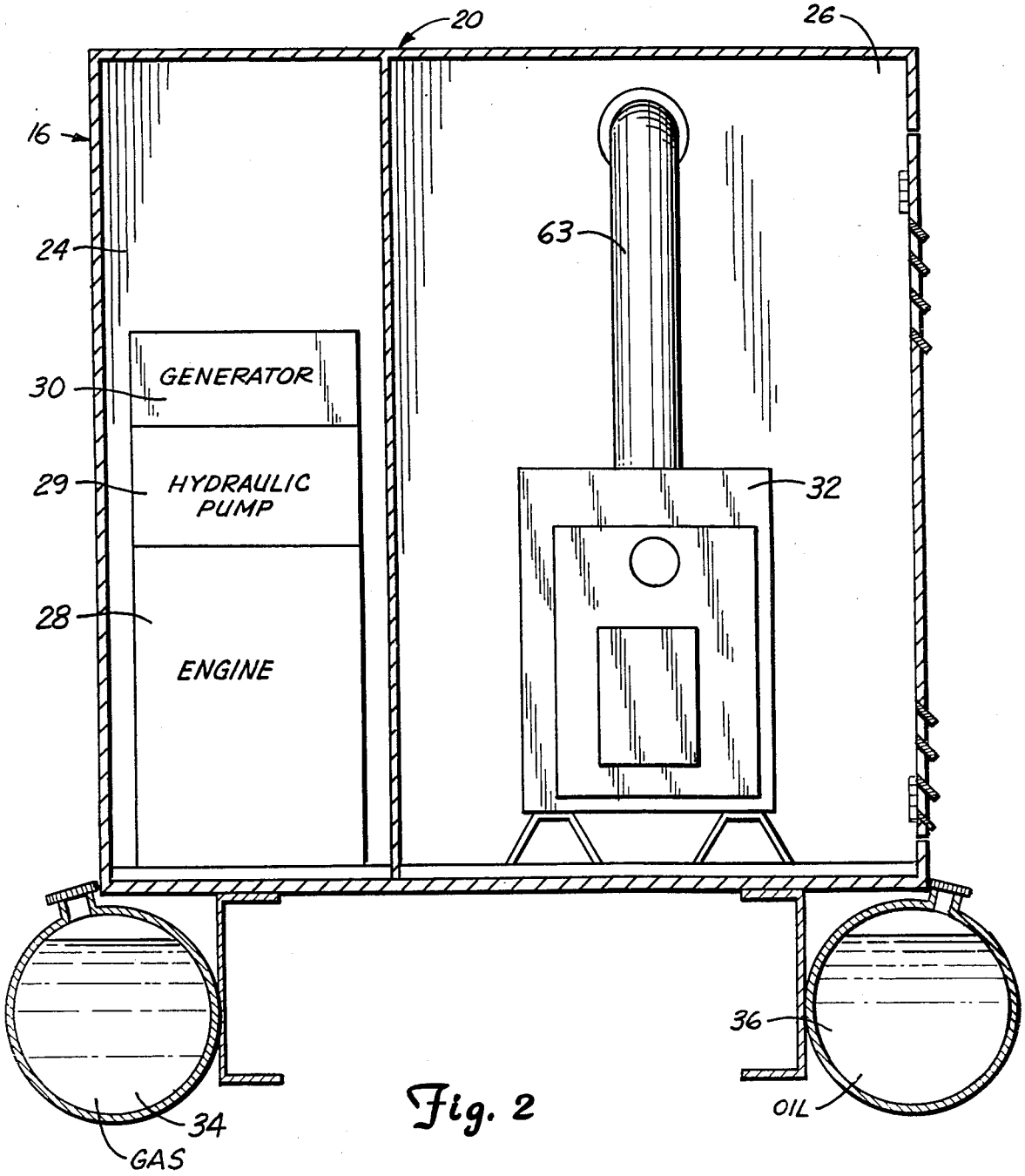
FIG. 2 is an enlarged vertical sectional view taken on the line 2—2 in FIG. 1 with parts omitted for clarity of illustration.

A snow removal apparatus 10 includes a motorized vehicle or truck 12 having a forwardly facing cab 14 and a truck box or body 16. A snow gathering device such as a snowblower 18 is supported on the front end of the truck in any usual or preferred manner. Many different snowblowers may be used effectively, but a series 8428 HYDRO KING snowblower by Erskine Manufacturing Company, Inc. which is hydraulically powered will be satisfactory.

Figure 3:
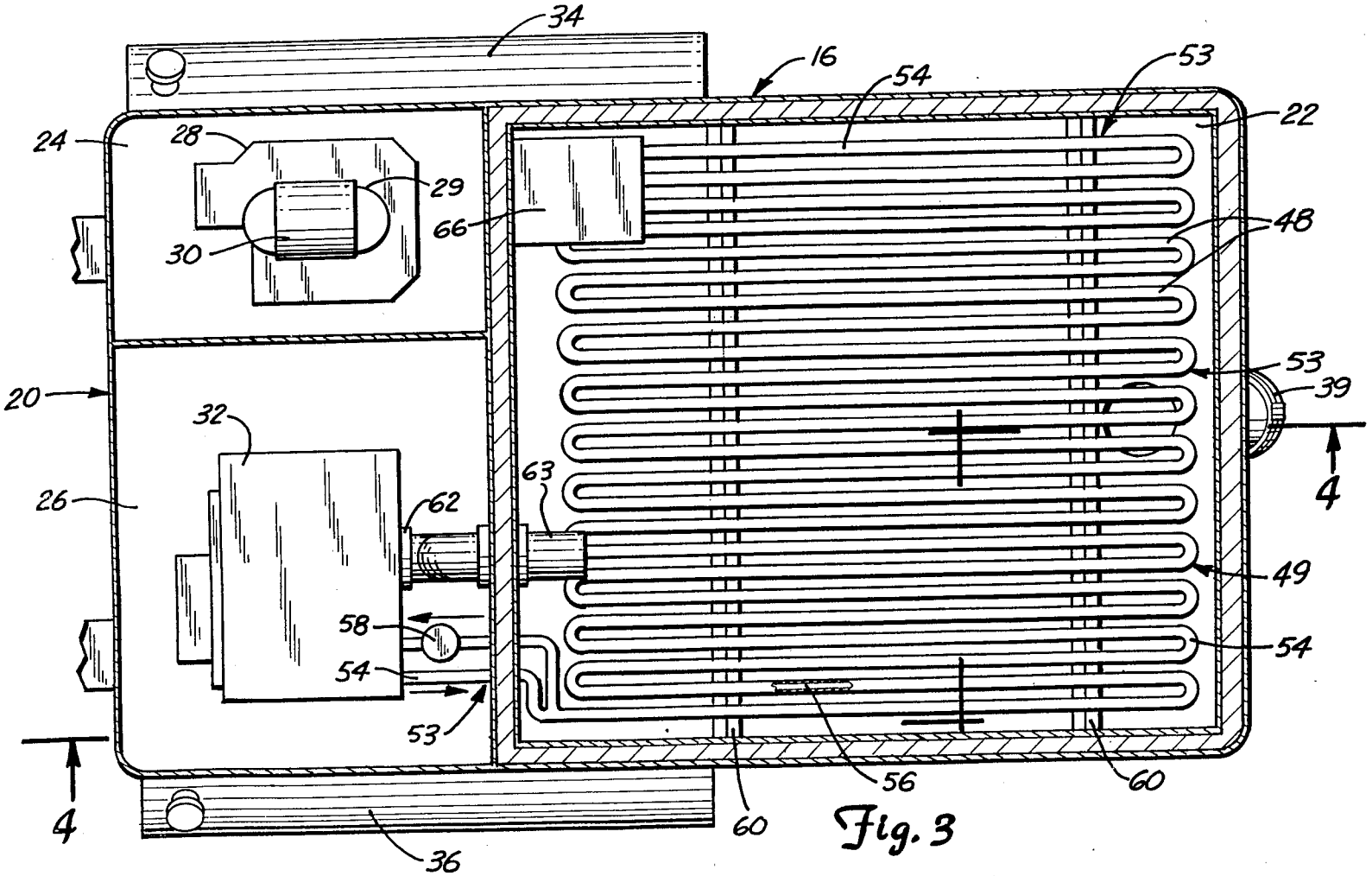
FIG. 3 is an enlarged horizontal sectional view taken on the line 3—3 in FIG. 1.

As best seen in FIG. 3, the truck box 16 includes an equipment compartment 20 at its forward portion, and a snow reduction chamber 22 filling the remainder of the box.

The equipment compartment is divided into an engine room 24 and a boiler room 26. The engine room houses an auxiliary engine 28 driving a hydraulic pump 29 and a generator 30. The pump 29 powers the snowblower 18.

The boiler room houses a combustion fired boiler 32 which provides the heat for reducing the frozen water (snow and ice) to liquid water. Any one of a number of different boilers could be used effectively, but a Crown/Freeport Series Cast Iron, Oil-Fired, Hydronic, Hot Water Boiler, Model CT-8 has been found satisfactory. The boiler motor will be powered by generator 30.

A gasoline tank 34 is supported adjacent a main chassis I-beam on the right side of the truck, and an oil tank 36 is similarly supported on the left side of the truck and is for supplying fuel to the boiler 32.

Figure 4:
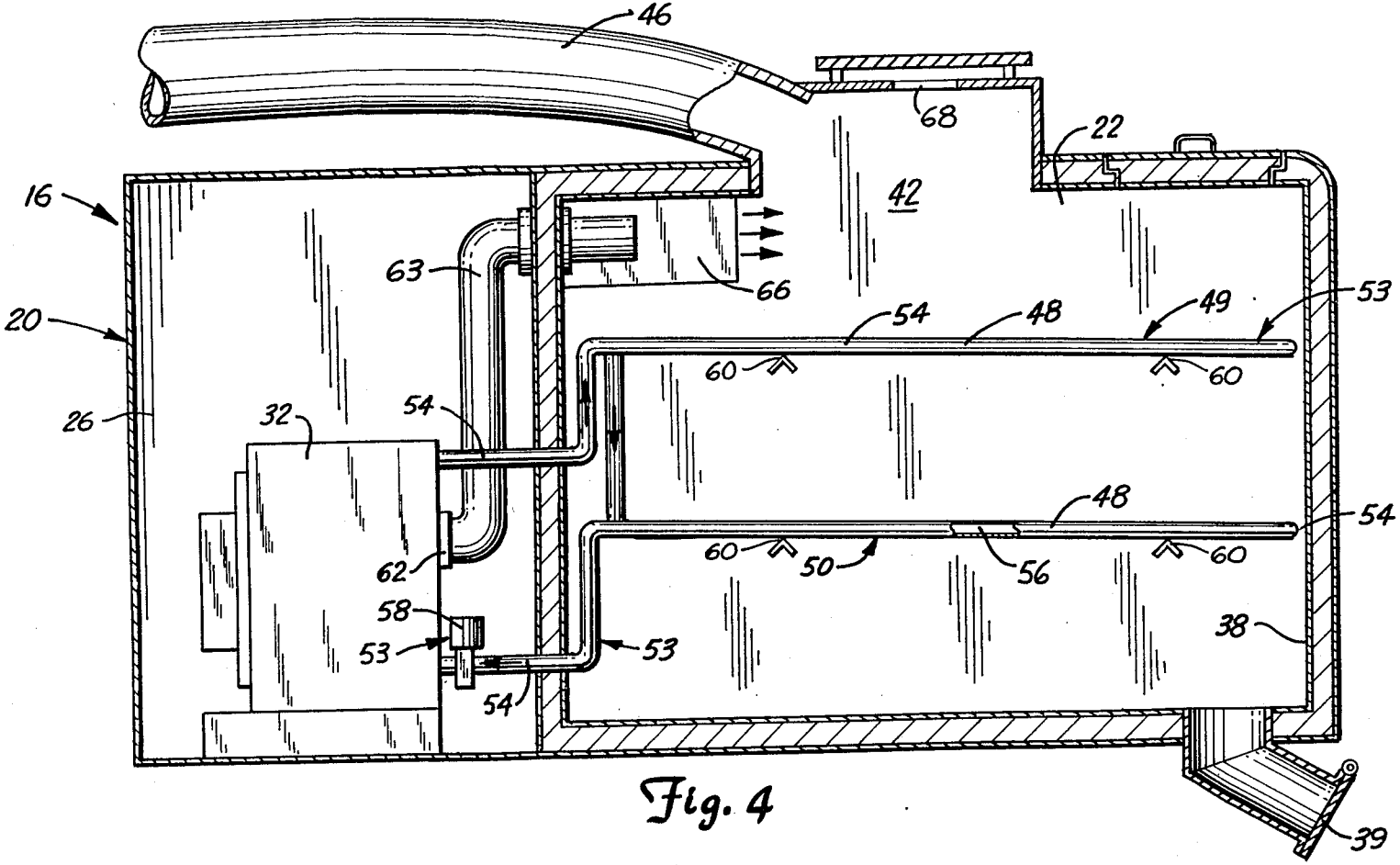
FIG. 4 is a vertical sectional view taken on the line 4—4 in FIG. 3.

As clearly seen in FIGS. 3 and 4, the top and bottom walls and all four side walls of the snow reduction chamber 22 are insulated to minimize heat transfer. The top wall is provided with a vent 68. A lower portion of the snow reduction chamber 22 is designated the liquid water holding tank 38, and this tank includes a normally closed, openable discharge port 39 at the tank bottom. A central upper portion of the snow reduction chamber 22 is identified as a snow entry area or a snow delivery conduit discharge area 42. The snowblower 18 includes an outlet chute 44; and a snow delivery conduit 46 receives snow from the chute 44 and is open into the chamber 22 to deliver snow and ice to the snow entry area 42.

As seen in FIGS. 3 and 4, a plurality of mutually parallel, spaced-apart, heated metallic boiler tubes 48 are situated in position below the snow entry area of snow conduit delivery area 42 so that snow entering the chamber 22 from delivery conduit 46 will be intercepted by these tubes. The tubes are arranged in two fields, a first upper field 49 and a second lower field 50. Each field lies in substantially one plane, and each of the planes are mutually parallel with the other. As seen in FIG. 4, the plane substantially including the first upper field 49 and the plane substantially including the second lower field 50 are effectively horizontal planes as far as the melting action or reducing action of the snow into liquid water is concerned; but by supporting one end of each of the fields of the coil slightly lower than the other end of that field (in this case the rearward end is lower than the forward end), any materials such as rocks which are inadvertently delivered with the snow to the reduction compartment, and which are too big to pass between the tubes, will eventually move to the lower end of the field of tubes due to the vibrations of the entire snow removal apparatus in operation. There they can be removed through the instrumentality of upper and lower tube access doors 51 and 52, respectively.

As clearly seen in FIG. 3, the space between the end loops of the spaced-apart boiler tubes 48 and the vertical wall of the snow reduction chamber 22 is greater than the space between adjacent parallel runs of these tubes. Therefore, solid materials traveling to the rear end of each field of tubes will tend to fall off of the tubes and collect adjacent the bottom portion of this vertical rear wall of chamber 22, where such rocks or other solid materials are smaller in size than the space between the tube ends and this rear wall. These solid materials may be flushed out through the discharge port 39 when the liquid water is being dumped; or they may be removed through a bottom access door 55.

Each of the heated boiler tubes 48 acts on the particular chunk of snow, snowflake, or frozen water molecule that comes in contact with its outer heated surface, and such frozen molecule changes from its frozen state to its liquid state. The molecules closely adjacent molecules in touch with the heated surface of a boiler tube also move from frozen to a liquid state by conduction of heat energy.

While acting separately, each of the boiler tubes is part of what is in effect a closed heat transfer system 53. Each boiler tube 48 is a part of what is in effect a single continuous, endless, boiler pipe 54, constituting part of that system. Other parts of the closed heat transfer system 53 include heat transfer fluid 56 filling the boiler pipe 54, boiler 32 that transmits heat energy to the heat transfer fluid through that part of the continuous boiler pipe 54 which is within the boiler, and pump means 58 to circulate the heat transfer fluid 56 through the pipe 54. The fluid 56 will have high conductivity and will not freeze when the apparatus is shut down in the cold. Water with radiator antifreeze will serve effectively. The pump means will be powered by generator 30.

As shown, the first and second fields are supported on horizontally extending runners 60. Other necessary or desirable bracing and the like has been omitted for clarity of illustration.

The diameter of the boiler tubes 48 and the space between tubes in each field of tubes will be determined upon consideration of such factors as the typical nature of the snow and ice which the apparatus is designed to handle (hard packed snow and ice chunks to be removed only at substantial intervals of time after the snow has fallen as opposed to new fallen snow to be removed directly after each snowstorm, for example); the lowest ambient temperature in which the apparatus is designed to work; the maximum depth of the snow cover which the apparatus is designed to handle; and the forward speed which the motor vehicle needs to maintain in continuous operation.

These factors are concerned with the maximum number of BTU's per hour needed for continuous operation. It has been calculated initially that for a tank 38 designed to reduce snow into up to 12,500 pounds of liquid water, the boiler tubes in each field can be made of 1½" outside diameter non-corrosive copper tubing spacing on 3" centers to give 1½" between tubes. This relatively close spacing can be made even closer, the diameter of the tubes 48 can be increased, and/or the BTU output of the boiler can be increased in any relative proportion with respect to the other factors should the snow load to be handled by the apparatus be found to overload, choke or clog the snow reduction chamber. Obviously the optimum design for use in a particular type of service in a particular geographical location will be determined by the demands made by the weather in that particular location.

As indicated by the direction arrows on FIGS. 3 and 4, the pump 58 will circulate the fluid 56 in direction so that the newly heated fluid proceeds out of the top of the boiler and into the first upper field 49, through each of the boiler tubes in that field, and then down to the second lower field 50 where, after circulating through each of those boiler tubes, it will be returned to the pump 58 and into the boiler to be reheated. This closed heat transfer system has very extensive advantages over the prior art systems which used and co-mingled the fluid and liquid melting medium with the snow or ice which is being reduced to liquid water; with the result that all heat energy expended by the heat source was lost and not just that needed in melting the snow. In addition to ensuring that the boiler tubes either within or without the boiler will not clog up, there is a very definite further advantage in that the tubes can be maintained very hot and far above the melting point of water so that even the last tube in the lower flight will be very effective in melting snow and ice which comes in contact with it or comes near to it, and yet all of the heat energy still in that last boiler tube when it goes back to the pump and boiler is retained. This vastly reduces the demands for heat energy of the system and greatly increases the efficiency of the system.

In situations where the snow removal apparatus of the invention is not stored inside, or even when it is in a garage such as an unheated garage, it will be advantageous to warm up the interior walls of the snow reduction chamber and to warm up the atmosphere inside of the chamber before attempting to use the snow removal apparatus for its intended purpose. For this purpose, a source of heat in addition to the heated boiler tubes can be used. In the form of the invention illustrated, two such additional sources of heat are shown, either one of which, or both of which, can be used.

The boiler 32 is provided with an exhaust flue 62 and an exhaust stack 63. Much heat energy "goes up the stack" in a typical combustion fired boiler. By way of example only, the exit temperature of the exhaust gases from the Model CT-8 boiler mentioned above can range from 450° to 800° F. depending on the fuel burned in the boiler. In the form of the invention as shown, exhaust stack 32 extends through the forward wall of the snow reduction chamber and opens into that chamber, carrying the hot products of combustion within the boiler together with any unburned oxygen in the air into the interior of the chamber to serve to preheat it as the boiler tubes are also being preheated preparatory to beginning to use the apparatus for its intended purpose. After the boiler tubes and the atmosphere within the chamber 22 and the walls of the chamber 22 have reached a sufficient temperature so that snow removal operations can begin, the heat from the exhaust stack 63 will still aid the reduction of snow to liquid water, and will further increase the efficiency of operation of the apparatus.

Where it is advisable to preheat the snow reduction chamber 22, the atmosphere inside of it, and at least the outsides of the boiler tubes 48, and it is not possible or desirable to fire up the boiler, a combination radiant heat and circulating fan unit 66 of any usual or preferred construction can be mounted in an upper portion of the chamber 22 well above the maximum height of any liquid water that would ever be collected in the holding tank 38. This unit can initially be powered by an electric line running from outside of the apparatus; and, after the apparatus begins to move to its location for use, can be powered by the generator 30.

In operation, the truck 12 will move the snowblower toward and into the snow to be removed with the snowblower being operated from power furnished by the hydraulic pump 20 and snow will be blown through the outlet chute 44 and the snow delivery conduit 46 into the central upper portion 42 of the snow reduction chamber 22 where it will fall on the first upper field of boiler tubes 49. Much of the snow will be melted and fall as liquid water onto and around the boiler tubes of the second lower field 50. The solid or slushy snow which passes between the tubes of the upper field without reaching a temperature above freezing will fall on the tubes of the lower field and will be melted into liquid water. Any snow or slush which falls between the tubes without reaching its melting point will drop into the water being collected in the bottom of the tank 38, that water initially being at a temperature well above the freezing point because of its contact with the boiler tubes of one or both of the fields.

It is well known that snow is an excellent insulating material because of its high air content. It is this high insulating quality which has apparently defeated all of the efforts of those working in the prior art to produce an effective, economically feasible, snow removal apparatus utilizing the snow reduction to liquid water principle. Because of the well known "snowball packing" qualities of snow, when a chunk of snow larger than the space between boiler tubes lands across two or more boiler tubes, the mass of the snow, when it hits the tubes, will cause the snow to tend to pack, thus immediately reducing the amount of insulating air into the snow above the tubes with which it is in contact. This greatly increases the conduction of the snow in contact with the upper portions of the tubes. Therefore, not only will the individual molecules in touch with the metallic tube surfaces instantly go from frozen to liquid state, but the other nearby molecules, due to increased conduction because of compaction, will also tend to melt more rapidly.

While two horizontal spaced-apart fields of boiler tubes are shown, it is to be understood that under the severe operating conditions of northern climates, the number of substantially horizontal fields can be increased.

Also, in geographical locations where the apparatus of the invention must operate at far, far below the melting point of snow and ice, a field of boiler tubes even closer to the bottom of tank 38 could be provided. This field would operate as do the ones above it when snow is first introduced into the chamber 22, and, when the liquid water comes up to the level of that lower field, it will continue to serve by preventing the liquid water from returning to its frozen state. In fact, the second lower field 50 will serve exactly that purpose once sufficient snow is reduced to liquid water and the water rises up to the level of the second field 50.

Although the present invention has been described with reference to preferred embodiments, workers skilled in the art will recognize that changes may be made in form and detail without departing from the spirit and scope of the invention.

What is claimed is:

1. A method for continuously disposing of snow and ice in ambient temperatures below the freezing point of liquefied snow and ice, the method including the steps of:

(a) providing an insulating snow reduction chamber with at least two generally horizontal, vertically spaced and vertically aligned fields of closely spaced-apart heated tubes, the chamber being provided with a snow and ice entry port above and vertically aligned with the uppermost field;

(b) heating the interior of the chamber and its contents to a temperature greater than the freezing point of the liquefied snow and ice;

(c) introducing sufficient liquid into the chamber to immerse the lowermost field of heated tubes;

(d) discharging snow and ice through the chamber entry port onto the uppermost field of heated tubes;

(e) supplying heat energy through the heated tubes at a rate sufficient to convert the snow and ice to liquid fast enough to prevent bridging over any of the fields of tubes and to maintain the liquid in the chamber above its freezing point; and (f) withdrawing liquid from the chamber as necessary to prevent the uppermost field from becoming immersed in liquid.

2. The method of claim 1 wherein:

(g) only such liquid is withdrawn from the chamber as to assure that the lowermost field of heated tubes will remain immersed.

3. The method of claim 1 wherein:

(g) the step of introducing liquid to immerse the lowermost field includes introducing a controlled amount of snow or ice through the chamber entry port and allowing it to liquefy to form at least part of the immersing liquid.

4. The method of claim 1 wherein:

(g) the step of introducing liquid to immerse the lowermost field includes introducing into the chamber liquid from an outside source to form at least part of the immersing liquid.

* * * * *